US007097080B2

(12) United States Patent
Cox

(10) Patent No.: US 7,097,080 B2
(45) Date of Patent: Aug. 29, 2006

(54) ATHLETIC HEADWEAR SHAPING DEVICE AND METHOD

(76) Inventor: William A. Cox, 1107 Wildbriar Dr., Liberty, MO (US) 64068

( * ) Notice: Subject to any disclaimer, the term of this patent is extended or adjusted under 35 U.S.C. 154(b) by 118 days.

(21) Appl. No.: 10/823,274

(22) Filed: Apr. 13, 2004

(65) Prior Publication Data

US 2005/0224529 A1 Oct. 13, 2005

(51) Int. Cl.
*D06C 15/00* (2006.01)

(52) U.S. Cl. ..... 223/84; 223/14

(58) Field of Classification Search ..... 223/84, 223/24, 25, 26, 52, 14; 2/209.13, 244
See application file for complete search history.

(56) References Cited

U.S. PATENT DOCUMENTS

D368,806 S * 4/1996 Sparaco ..... D32/58
5,533,652 A 7/1996 Levin
5,685,465 A 11/1997 Berardis
5,862,522 A * 1/1999 Cho ..... 2/195.1
5,908,146 A 6/1999 Levin
5,991,927 A 11/1999 Barbaccia
6,315,175 B1 11/2001 Berger
6,755,329 B1 * 6/2004 Thompson ..... 223/14
6,824,027 B1 * 11/2004 Frey ..... 223/14
2003/0019890 A1 1/2003 Lawrence
2003/0217405 A1 11/2003 Thompson
2003/0226861 A1 12/2003 Frey

* cited by examiner

*Primary Examiner*—Danny Worrell
(74) *Attorney, Agent, or Firm*—Chase Law Firm, L.C.

(57) ABSTRACT

An improved headwear shaping device which is compact, lightweight, modular and contains an arcuate channel for receiving the visor portion of athletic headwear, shaping the visor by applying equal pressure throughout the perimeter of the visor. The shaping device also provides a stabilizing arm perpendicular to the inserted visor causing the visor to extend parallel to the horizontally axis of the cap for display and storage. The unitary shaped body of the invention is comprised of a lightweight, compact, cost-effective rigid material which also provides for enhanced portability of headwear while not in use.

6 Claims, 2 Drawing Sheets

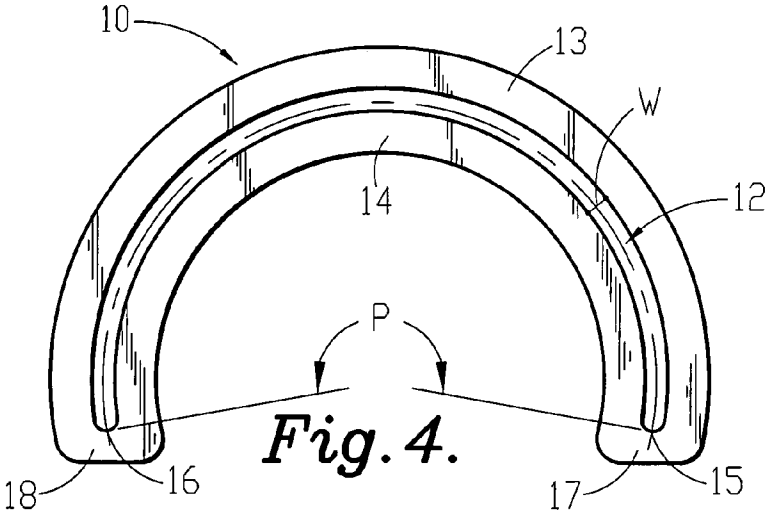
Fig. 4.
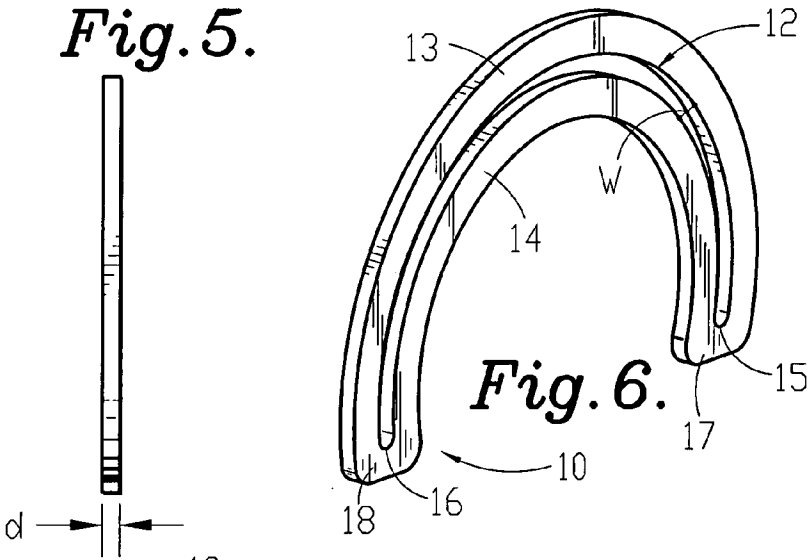
Fig. 6.
Fig. 5.
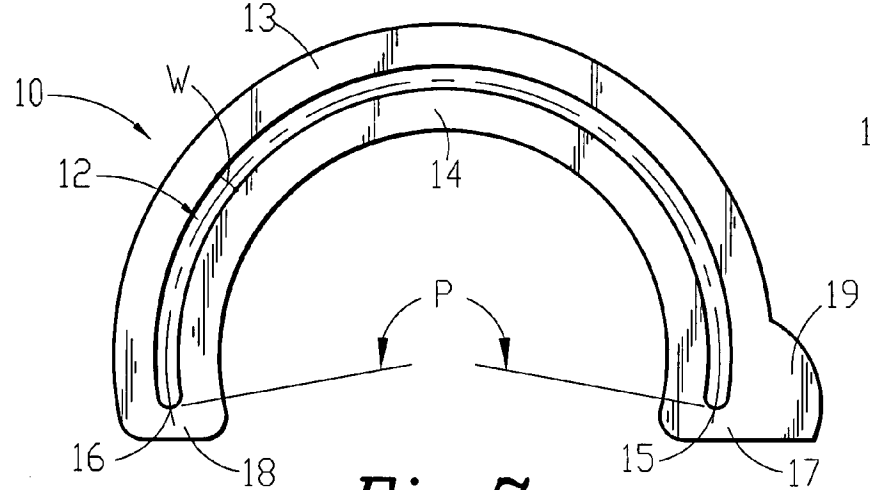
Fig. 7.
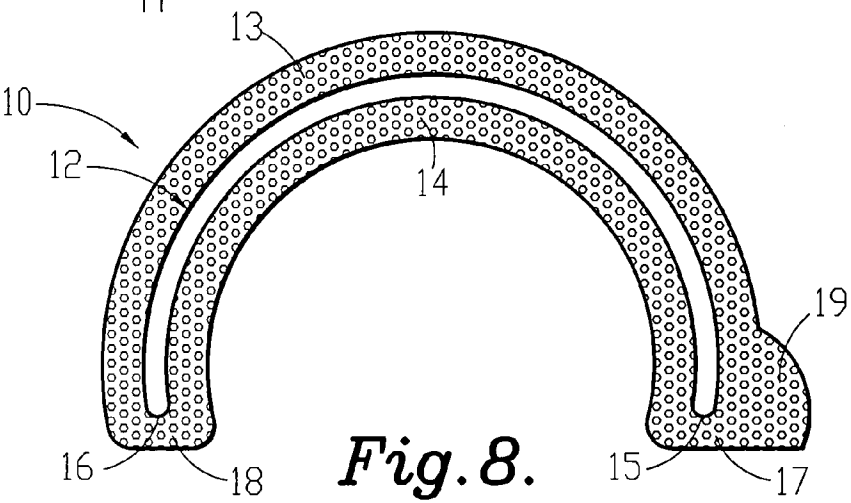
Fig. 8.

ATHLETIC HEADWEAR SHAPING DEVICE AND METHOD

BACKGROUND

1. Field of Invention

The present invention relates generally to a method and apparatus for shaping, storing, transporting and displaying athletic headwear. More particularly, the present invention relates to a method and apparatus for causing and maintaining a definite arch shape in the visor portion of a sports cap while the cap is being stored, transported or displayed. In addition, the lightweight, arched device allows for modular storage, easy transportation and enhanced display of the athletic headwear.

2. Description

Various methods for curving the visor of headwear have been used for some time. Headwear—in particular sport team memorabilia such as ball caps—is fashionable, practical and comfortable. The most common type of headwear includes sports caps which have visors attached to help block out the sun and which are usually constructed of fabric covered cardboard or plastic. The purpose of a visor is to fashionably protect the face of the wearer from the environment, including rain, wind, and sun by providing a lateral appendage which extends from the head of the wearer. Because a flat visor is not as effective at blocking the rain, wind and sun and because an arched visor is more comfortable and considered more aesthetically pleasing, a visor is most effective if curved. However, most headwear manufacturers produce a flat visor.

The visor is usually constructed of a rigid material to help provide support to allow the visor to extend outward from the face and keep the visor from succumbing to the rain and wind. Because the material which forms the visor is rigid, it is not easy to maintain an arch in the visor. In fact, the current methods for curving the visor are problematic.

One method for curving the visor involves manually rolling the visor according to the wearer's preference. Other manual methods include using rubber bands of various types and sizes to curve the visor. Not only do these methods create an inconsistent arch and cause an early break-down of the visor materials due to the repeated physical stress of the materials, but also these methods fail over time and the visor loses its arch shape within a relatively short timeframe.

Another method of curving the visor involves using an apparatus to create tension on the visor either from compression, steam, hot air or moisture to impose an arch in the rigid visor material. These machines are costly, burdensome, bulky and difficult to use. Because of the stress imposed on the visor, visor breakdown is accelerated.

A third method currently used is to curve headwear during use. However, these devices change the nature of the headwear, increasing the weight of the headwear, changing the aesthetics and altering the mass distribution, ultimately causing the visor to wear lower on the head. In addition, because of the nature of the curving device, which remains on the headwear during use, over time a permanent discoloration of the visor will occur.

Another challenge is transporting headwear while retaining the curved arch. When packing headwear to travel, the visor is often smashed between multiple layers, causing the visor to lose any arch in the visor. Current methods involve bulky machinery or multiple components, which can be lost or damaged and thereby do not lend themselves to traveling.

Another known problem is that while traveling, in an effort to store the headwear inside the luggage, the headwear is often crushed or reshaped when other items are packed on top of the headwear or during the transportation of the luggage.

There is a need for a visor curving device which is compact, lightweight, easy to use, with a fixed arcuate channel for curving the visor during non use, providing a professional and aesthetic display during storage and transportation, while requiring a reduced material composition and therefore a more economical use of material and space.

Information relevant to attempt to address these problems can be found in U.S. Pat. Nos. 5,553,652; 5,685,465; 5,908,146; 5,991,927; 6,315,175; and published U.S. Patent Application No. 2003/0019890; 2003/0226861; and 2003/0217405. However, each one of these references suffers from one or more of the following disadvantages: unequal distribution of pressure, aesthetically distracting, inconsistent curve, overly complex, non-modular design, massive and non-economic use of material and space.

For the foregoing reasons, there is a need for a device which solves these problems by providing a cost effective, compact, lightweight device with a fixed arch for curving a visor.

SUMMARY OF THE INVENTION

The advantages of the present device include the simplicity, ease of use, light weight, reduced material consumption and compactness, all of which provide an improved method for shaping athletic headwear.

In addition, the present invention provides a unique display method which allows graphical images to be affixed along the arch or on the stabilizing arm of the shaping device. The present invention also provides a unique modular storage method by allowing the stacking of a plurality of headwear on top of one another positioning the bottom portion of one shaping device on top of the visor portion of another.

The current invention also solves the problem of transporting athletic headwear by allowing the user to place the visor portion of the headwear inside the curving device and then pack the headwear. The curving device will pack easily, maintain the visor's arch and is lightweight. In addition, because the headwear curvature device is comprised of a single compact unitary device, it will not get lost or tangled during transportation and will not take up a large space within the luggage.

It is an object of the current invention to provide an improved device, which modifies the visor portion of headwear by providing a simpler, easier to use, lightweight, compact and cost efficient shaping device which improves the method for shaping, storing, transporting and displaying athletic headwear.

It is a specific object of the invention to provide such a device which is comprised of an arch shaped structure attached to and supported by a stabilizing support member. The arch structure has an opening defined by a first terminal end and a second terminal end spaced apart a sufficient distance to allow the opening to receive the visor portion of headwear. The opening bisects the arch structure into an upper arcuate portion and a lower arcuate portion such that the upper and lower arcuate portions cause uniform pressure along the perimeter of the visor shaping the visor into the fixed arch shape. In addition, the invention provides an improved method for displaying, transporting, shaping and storing the athletic headwear.

In accordance with one aspect of the present invention, the shaping device is comprised of a unitary shaped body which includes an arch structure connected to and supported by a stabilizing arm. The arch structure provides a channel to receive the visor portion of athletic headwear.

In accordance with a second aspect of the invention, the invention provides an improved method for displaying the headwear such that a graphical image is affixed along the front face of the shaping device.

In accordance with a third aspect of the invention, the invention provides an improved method for storage of the headwear such that the shaping device provides support and spacing for the headwear while being stored.

In accordance with a fourth aspect of the invention, the invention provides an improved method for transporting the headwear such that the lightweight and compact shaping device maintains the shape of the headwear during transportation.

These, and further features and advantages of the invention, may be better understood with reference to the accompanying specification and drawings which illustrate by way of example, the principles of the invention.

BRIEF DESCRIPTION OF THE DRAWINGS

The accompanying drawings illustrate the present invention. In such drawings:

FIG. 4 depicts the front face of the current invention.

FIG. 5 depicts a side profile of the current invention.

FIG. 6 depicts a profile view of the current invention rotated along the vertical axis.

FIG. 7 depicts the front plan view of the preferred embodiment of the current invention.

FIG. 8 depicts the front plan view of an alternative embodiment of the current invention.

DETAILED DESCRIPTION OF THE INVENTION

Figure 1:
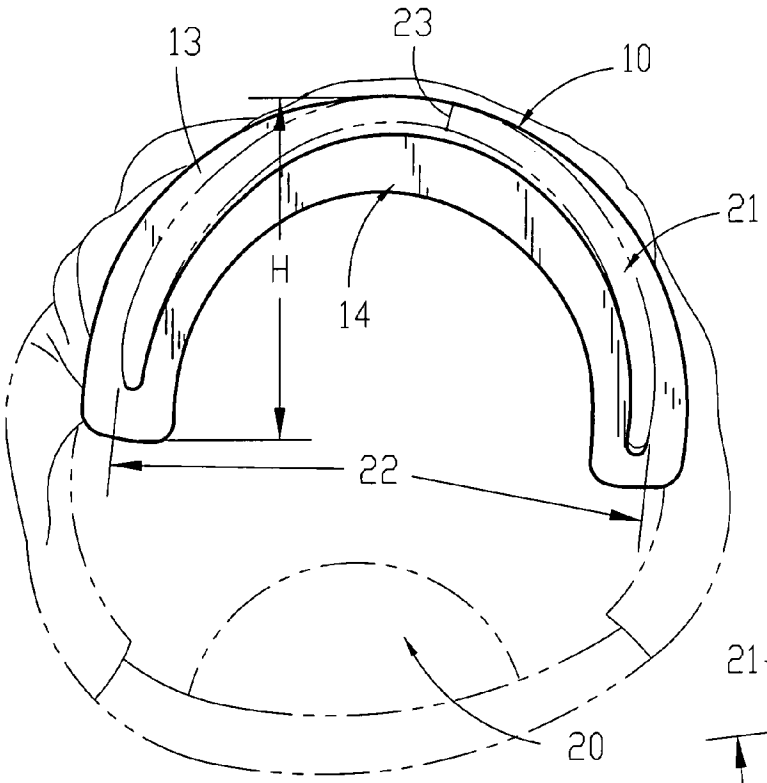
FIG. 1 depicts the front view of the improved shaping device in which the visor portion of the headwear is inserted inside the arcuate shaped channel of the shaping device.

These, and further features of the invention, an improved athletic headwear shaping device, may be better understood with reference to the accompanying specification and drawings depicting the preferred embodiment, in which: FIG. 1 depicts a front view of the improved shaping device (10) and athletic headwear (20) in which the visor (21) is positioned in the channel (12) of the device. The improved shaping device (10) is an arcuate unibody device which is generally semi-circular. The shaping device is separated by an arcuate channel (12) into an upper arcuate region (13) and a lower arcuate region (14). The channel (12) has a first terminal end (15) and a second terminal end (16) which are connected to the first support stabilizing arm (17) and the second support stabilizing arm (18).

The shaping device (10) is designed to receive a visor (21) of standard width (22) and thickness (23). The molded visor will generally be semi-circular defined by a height (H) above a horizontal plane and an accurate width (W) bisected by the vertical axis of the headwear.

As shown in FIG. 1 the headwear's visor (21) fits into the shaping device (10) such that the upper arcuate region (13) and the lower arcuate region (14) distribute complementary forces along the perimeter of the visor (21) while positioned inside the channel (12). In FIG. 1, the visor (21) of the headwear (20) is molded by distributing a downward force along the outer perimeter of visor (21) which is in contact with the upper arcuate region (13) and by distributing an upward force along the inner perimeter of visor (21) which is in contact with the lower arcuate region (14). The upper arcuate region (13) forces the visor (21) against the lower arcuate region (14). Conversely, the lower arcuate region (14) forces the visor (21) against the upper arcuate region (13). These complementary forces mold the visor (21) into an arcuate shape.

Figure 2:
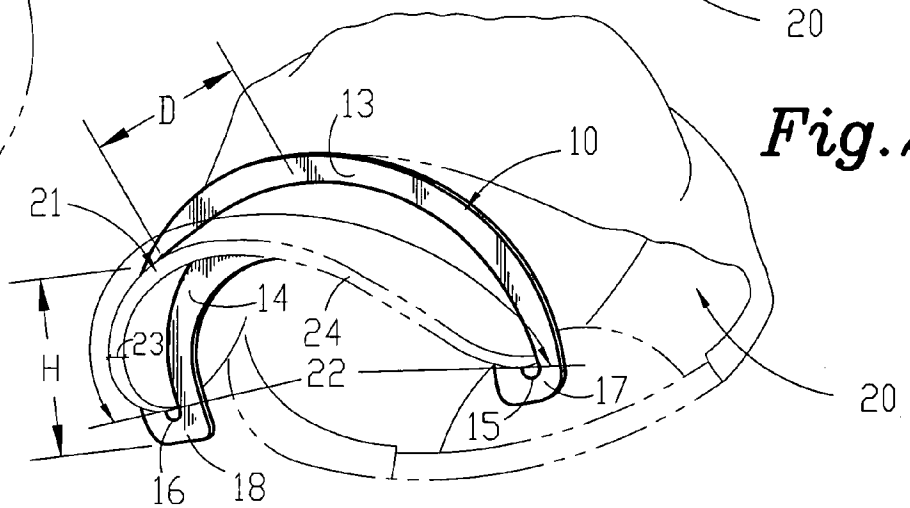
FIG. 2 depicts a front profile view of the improved shaping device in which the arcuate shaped channel is in receipt of the headwear's visor.

FIG. 2. depicts a front perspective view of the improved shaping device in which the visor (21) is inserted a distance (D) from the edge of the visor (24) through the channel (12) of the shaping device (10). As seen in FIG. 2 the first and second terminal ends (15 & 16) are connected to a first stabilizing support arm (17) and a second stabilizing support arm (18).

In the preferred configuration the stabilizing support arms (17 & 18) are perpendicular to the visor (21) and at least one stabilizing support arm (17) is elongated outward to prevent rotation of the headwear. In addition, the preferred elongated support arm (17) has an elongated shape (19) which facilitates the placement of a graphical image onto the shaping device in close proximity to the shaped visor (21). The first and second support stabilizing arms (17 & 18) are preferably flat on their base, parallel to one another and fabricated from the same rigid material as the shaping device (10).

FIG. 2 also depicts the elevation and support of the visor (21) by the shaping device (10). Insertion of the visor (21) into the channel (12) of the shaping device (10) a distance (D) from an external edge of the visor (24) elevates the visor a height (H) above the horizontal plane.

The elevation of the visor (21) defines the molded shape and enhances the display characteristics of the headwear (20). This configuration also enhances the display of the headwear by allowing graphical images to be affixed along both the upper (13) and lower (14) arcuate portions of the device. In addition to the arcuate portions, the supporting structures (17 & 18) can display graphical images. By improving material efficiency, by elevating the visor above the horizontal plane and by displaying graphical images in multiple locations on the shaping device (10), the invention is an improvement over earlier inventions.

Figure 3:
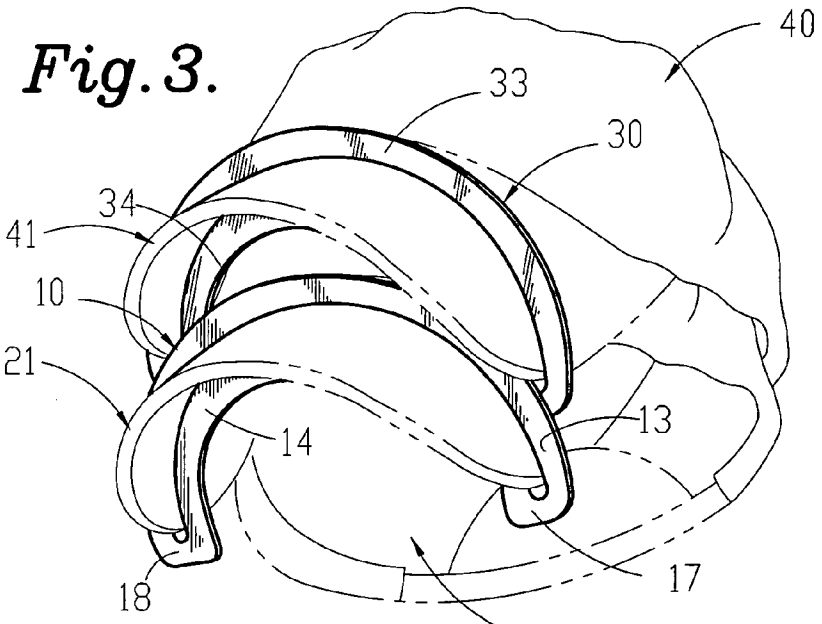
FIG. 3 depicts a front profile of a plurality of headwear positioned such that the visor filled shaping devices are positioned vertically on top of each other.

FIG. 3 depicts a plurality of headwear (20) and headwear devices (10) stacked vertically. The headwear can also be positioned side-by-side laterally from one another along a horizontal plane. In the preferred vertical arrangement the second headwear (40) is stacked on top of the first headwear (20). The first headwear visor (21) is inserted into the first shaping device (10). The second headwear visor (41) is inserted into the second shaping device (30). The lower arcuate portion (34) of the second shaping device (30) rests on top of the visor portion (21) of the first headwear (20) which is supported by the stabilizing support arms (17 & 18).

This improved, modular, compact, space saving design can accommodate a variable number of headwear (20) stacked vertically while molding the headwear visor (21) and provide for the display of a graphical image along the upper and lower arcuate portion (13 & 14) or on the stabilizing support arms (17 & 18).

FIG. 4 depicts the front plan view of the unibody shaping device, preferably constructed of a firm material such as metal or rigid plastic having an arched shape with a generally semi-circular cross section. The arcuate channel (12) which separates the unibody device. Said channel (12) having an upper edge, a lower edge, said upper edge separated from the lower edge by a width (W) that is greater than or equal to standard thickness (23) of the visor (21) and an arch length (P) that is equal to or greater than a lateral width (22) of the visor (21). In the preferred embodiment, P is approximately four inches in circumference and W is approximately one-quarter (¼) of an inch. The channel (12) has a first terminal end (15) a second terminal end (16) which define the perimeter of the channel and allow for positioning of the visor (21). In the preferred embodiment the first terminal end (15) and a second terminal end (16) are each integrated into the support stabilizing arms (17 & 18) of the shaping device. The shaping device (10) is preferably comprised of a single piece of rigid ABS plastic with an opening for the arcuate shaped channel (12) which extends through the interior of the device (10).

The portion of the shaping device (10) external to the arcuate channel (12) is referred to as the upper arcuate portion (13). The portion of the shaping device (10) internal to the arcuate channel (12) is referred to as the lower arcuate portion (14). In the preferred embodiment, one support stabilizing arm (17) is configured to prevent the athletic headwear from rotational movement along the longitudinal axis by elongating the stabilizing arm outward. In the preferred embodiment, this elongated support stabilizing arm (17) is of sufficient design (19) to allow a graphical image to be affixed near the first terminal end (15) and adjacent to the channel opening (12).

FIG. 5 depicts the side plan view which shows the improved shaping device (10) with a device thickness (d) which separated the front surface from the back surface. In the preferred embodiment the shaping device thickness (d) is one-eighth (⅛) inches thick. By minimizing the device thickness (d), the invention has an improved material efficiency over the current shaping devices. However, this thickness is optimized to provide sufficient support to mold and support the visor (21) during the invention's use.

FIG. 6 depicts the invention rotated around the vertical axis.

FIG. 7 depicts the preferred embodiment of the invention in which the support stabilizing arm (17) is elongated and preferably shaped (19) to display a one-half (½) inch graphical image adjacent to the arcuate channel (12).

FIG. 8 depicts an alternative embodiment of the invention in which the shaping device (10) is fabricated of a perforated material, further improving material efficiency.

The invention further includes a method for shaping the visor (21). The method comprises a plurality of steps. First, providing an article of headwear (10) having a visor (21) and providing an improved shaping device (20). The improved shaping device (20) has a channel (12) of width P sufficient to receive a standard width visor (21) and first and second support stabilizing arms (17 & 18). The visor (21) is inserted into the channel (12) such that the upper arcuate region (13) and lower arcuate region (14) forcibly hold the visor inside the channel (12). By forcibly holding the visor (21) inside the arcuate shaped channel (12), the improved shaping device imparts the desired shape on the visor (21).

The invention further includes a method for displaying the visor (21). The method comprises a plurality of steps. First, providing an article of headwear (10) having a visor (21) and providing an improved shaping device (20). The improved shaping device (20) has a channel (12) of width P sufficient to receive a standard width visor (21), upper and lower arcuate regions (13 & 14), first and second support stabilizing arms (17 & 18) and graphical images affixed to stabilizing arms. The visor (21) is inserted into the channel (12) such that the upper arcuate region (13) and lower arcuate region (14) forcibly hold the visor inside the channel (12). By forcibly holding the visor (21) inside the arcuate shaped channel (12), the improved shaping device forces the visor to extend horizontally, allowing for an improved graphical display alongside the visor (21).

The invention further includes a method for storing the visor (21). The method comprises a plurality of steps. First, providing a plurality of articles of headwear (10) having a visor (21) and providing a plurality of improved shaping devices (20). Each improved shaping device (20) has a channel (12) of width P sufficient to receive a standard width visor (21) upper and lower arcuate regions (13 & 14), and first and second support stabilizing arms (17 & 18). Each visor (21) is inserted into the channel of each shaping device (12) such that the upper arcuate region (13) and lower arcuate region (14) forcibly hold the visor inside the channel (12). Each successive headwear shaping device-combinations is vertically placed on top of one another such that each lower arcuate region (14) rests on the visor (21) of the previous item of headwear (10). By vertically stacking the headwear, an improved storage method is obtained. Although the present invention has been described in considerable detail with reference to certain features or preferred versions thereof, other versions are possible and the invention does not require the incorporation of all advantageous features into every embodiment of the invention. For example, multiple channels or multiple configurations for receiving a visor (21) or alternative stabilizing support arms (17 & 18) can be configured which support the arcuate shaping device (20). Therefore, the spirit and scope of the appended claims should not be limited to the description of the preferred versions contained herein.

Having thus described the invention, what is claimed as new and desired to be secured by Letters Patent is as follows:

1. A device for shaping the visor portion of athletic headwear said visor having a lateral width and a longitudinal width, comprising:

a unitary shaped body comprised of a rigid material composition having a front surface, a back surface and a depth, the front surface separated from the back surface by said depth;

a stabilizing support member;

a channel dividing said unitary shaped body into an upper arcuate portion and a lower arcuate portion, said channel having an upper edge, a lower edge, an opening width, an arch and a length such that said opening width separates the upper edge from said lower edge such that said upper edge is adjacent to said upper arcuate portion and said lower edge is adjacent to said lower arcuate portion for the length of said arch; and said front surface being adapted for displaying a graphical image along said top region and said bottom region wherein said graphical image is divided by said channel.

2. The device of claim 1 wherein said stabilizing support member further includes an elongated appendage generally extending from said stabilizing support member, said appendage being generally perpendicular to said visor portion while said visor is inserted into said channel whereby said appendage is adapted for maintaining the visor in an upright position while preventing the headwear from horizontal rotation.

3. The device of claim 2 wherein said appendage allows for the display of graphical images.

4. A method for displaying athletic headwear having a visor placed on a horizontal surface, comprising: providing at least one unibody arcuate shaping device comprised of rigid material with a front face and at least one stabilizing arm, an elongated appendage extending from said stabilizing arm and a channel separating said rigid material into an upper arcuate region and a lower arcuate region designed to receive said visor; receiving said visor a distance from the visor's edge by the arcuate shaping device; supporting said visor parallel to said horizontal surface; stabilizing said visor in a horizontal orientation and displaying said visor in said arcuate shaping device.

5. The method of claim 4 further comprising the step of affixing a graphical image along the front face of said arcuate shaping device whereby said graphical image is divided by said channel.

6. The method of claim 4 further comprising the step of affixing a graphical image on the stabilizing arm appendage.

* * * * *